US008888055B2

(12) United States Patent
Kramer

(10) Patent No.: US 8,888,055 B2
(45) Date of Patent: Nov. 18, 2014

(54) STAKE FOR BAG MOUTH HOLDER AND OPENER

(71) Applicant: Ross Robert Kramer, Portsmouth, NH (US)

(72) Inventor: Ross Robert Kramer, Portsmouth, NH (US)

( * ) Notice: Subject to any disclaimer, the term of this patent is extended or adjusted under 35 U.S.C. 154(b) by 0 days.

(21) Appl. No.: 13/846,301

(22) Filed: Mar. 18, 2013

(65) Prior Publication Data

US 2013/0248678 A1 Sep. 26, 2013

Related U.S. Application Data

(60) Provisional application No. 61/685,580, filed on Mar. 21, 2012.

(51) Int. Cl.

| | |
|---|---|
| ***B65B 67/04*** | (2006.01) |
| ***B65D 33/00*** | (2006.01) |
| ***B65F 1/14*** | (2006.01) |

(52) U.S. Cl.

CPC ..... *B65D 33/00* (2013.01); *B65F 2240/138* (2013.01); *B65F 1/1415* (2013.01)

USPC ..... 248/99; 248/156

(58) Field of Classification Search

CPC ..... E04H 12/2215; E01F 9/0117; G09F 7/18; E02D 5/80; B65D 33/00; B65F 1/1415; B65F 2240/138

USPC ..... 248/95, 97, 99–101, 156, 545

See application file for complete search history.

(56) References Cited

U.S. PATENT DOCUMENTS

| | | | | |
|---|---|---|---|---|
| 2,939,468 | A | 6/1960 | Boyce | |
| 2,968,850 | A | 1/1961 | Tinnerman | |
| 3,473,770 | A | 10/1969 | Edgerton | |
| 4,867,401 | A * | 9/1989 | Graff | 248/99 |
| 6,256,942 | B1 | 7/2001 | Schatz | |
| 6,938,384 | B1 | 9/2005 | Hodge | |
| 7,302,904 | B2 * | 12/2007 | Burns | 114/294 |
| 8,100,370 | B1 | 1/2012 | Kramer | |
| 8,333,351 | B2 | 12/2012 | Kramer | |
| 2001/0032911 | A1 * | 10/2001 | Gabl | 248/99 |
| 2010/0200709 | A1 * | 8/2010 | Wilkinson | 248/99 |

* cited by examiner

*Primary Examiner* — Gwendolyn W Baxter

(74) *Attorney, Agent, or Firm* — Mesmer & Deleault, PLLC

(57) ABSTRACT

A stake for keeping a bag mouth holder and opener and refuse bag in combination secured to the ground in a fixed position whereby the bag mouth holder and opener has the general shape of a rectangular perimeter of a hyperbolic paraboloid to which the stake can be removably attached or integrally connected such that the stake can be driven in to the ground when the bag mouth holder and opener is positioned in the mouth of a bag.

9 Claims, 11 Drawing Sheets

STAKE FOR BAG MOUTH HOLDER AND OPENER

This application claims the benefit of U.S. provisional patent application No. 61/685,580, filed Mar. 21, 2012.

BACKGROUND

This invention relates to bag mouth holders, specifically to the bag mouth holder and opener that is used for leaf and lawn waste bags. Bag mouth holders can be helpful in keeping the mouth of a bag open during the filling process. The filling process can involve many difficult steps including grabbing and holding yard waste as well as lifting the waste so that it can be inserted in to an upright bag. These difficult steps can be avoided by laying both the bag and bag mouth holder sideways on the ground and raking yard waste directly into the bag. The bag combined with a bag mouth holder and opener is commonly set on the ground and is free to move until it is filled with enough yard waste to prevent the bag from moving. Because filling a lawn and leaf bag in this manner can cause the bag and holder in combination to move out of position as the rake or yard waste contacts and pushes the bag mouth holder or bag edge, it is helpful to maintain the bag and bag mouth holder in combination in a fixed position on the ground. Wind and other external forces can also cause the bag and bag mouth holder in combination to move out of position. One solution to this problem has been for the user to rest a tool or sticks on top of the bag to prevent it from moving. Another solution has been to partially fill the bag with a small amount of yard waste so that it has enough weight to maintain its position against the force of wind or raking. The user may also position the bag against another object to brace it from movement while filling it with yard waste.

SUMMARY

The above-described methods used to stabilize a lawn and leaf bag have not adequately addressed the problem of lawn and leaf bags moving across the ground while filling or because of wind. Having to weight a lawn and leaf bag with yard waste requires more bending over, handling yard waste by hand, and impairs efficiently raking yard waste into the bag. Placing objects on top of the bag may collapse the bag, defeating the purpose of using a bag mouth holder and opener in the first place. Further, a stable object used to brace the bag is not always available or conveniently located. Therefore, what is needed is an improved device and method to maintain the position of a lawn and leaf bag when using a bag mouth holder and opener.

It is an object of the present invention to provide a device for maintaining a bag in combination with a bag mouth holder and opener having the general shape of a rectangular perimeter of a hyperbolic paraboloid to a fixed position on the ground.

The present invention accomplishes this and other objects by providing a stake for use with a bag mouth holder and opener such as described, for example, in U.S. Pat. Nos. 8,100,370 and 8,333,351, which are incorporated herein by reference in their entireties. In one embodiment, a stake has a head, a clip portion and a stake portion, where the head and clip portion loop over and removably attach in mating agreement to an upper member of a bag mouth holder and opener. A clip portion has a tip with a catch surface that engages and retains the upper member of the bag mouth holder and opener in a loop formed by the head and the clip portion.

In another embodiment, a stake comprises a unitary structure with a bag mouth holder and opener where the head extends from the upper member of the bag mouth holder and opener. In a method of using a stake with a bag mouth holder and opener, the bag mouth holder and opener is positioned within a bag with the stake positioned outside the bag's mouth. The stake is then pressed into the ground by applying a force to the head of the stake. The stake can be operated by foot, by hand, or in any other manner such that it can be driven in to the ground to keep the bag and bag mouth holder and opener in combination secure to the ground in a fixed position.

DETAILED DESCRIPTION

Figure 1:
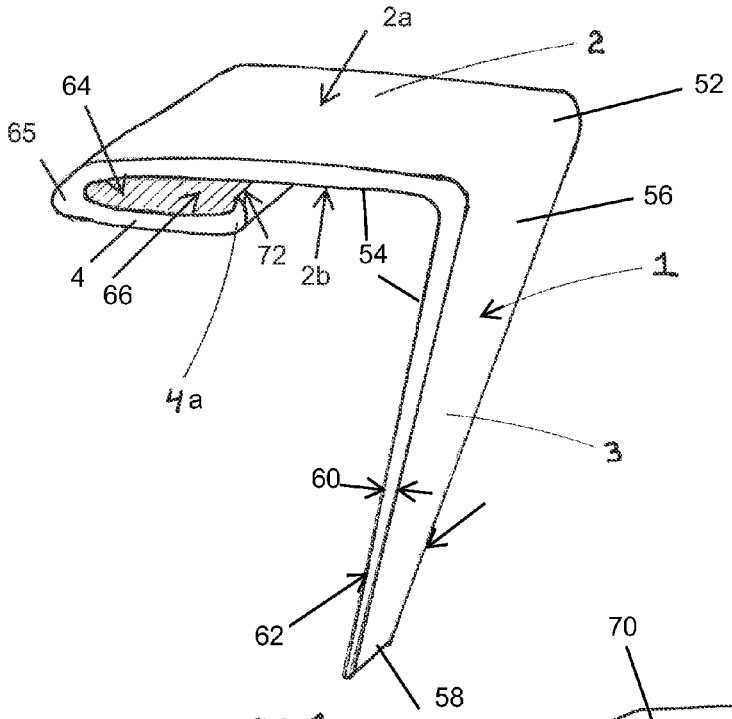
FIG. 1 is a perspective left side view of one embodiment of a stake of the present invention and shows a head, a spike portion, and a clip portion.
Figure 2:
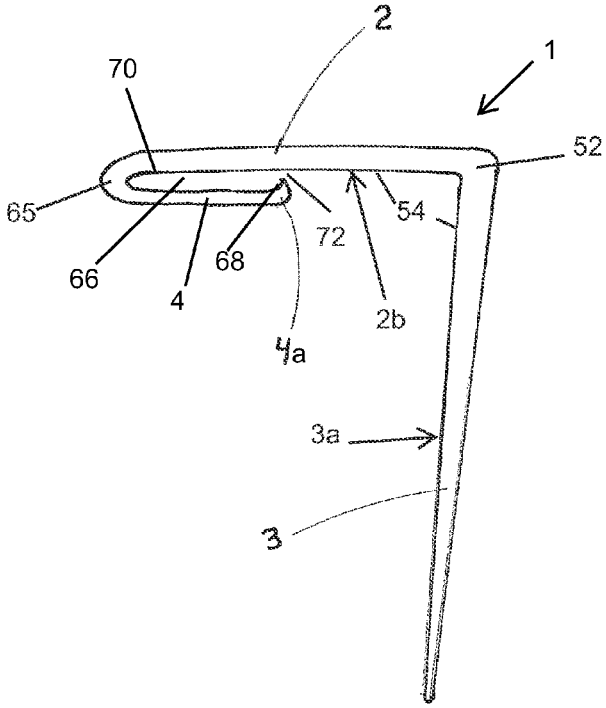
FIG. 2 is a left side view of the stake of FIG. 1
Figure 3:
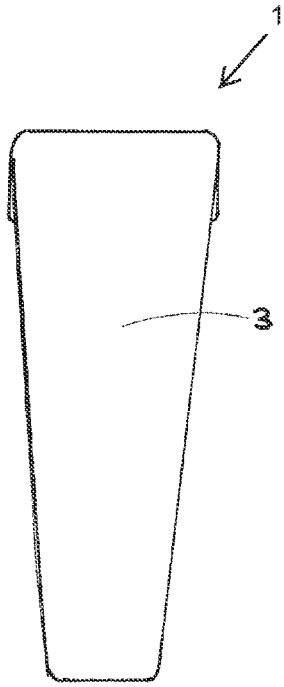
FIG. 3 is a front side view of the stake of FIG. 1
Figure 4:
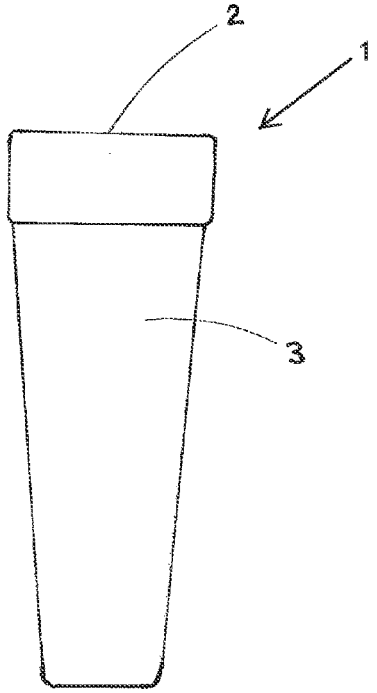
FIG. 4 is a back side view of the stake of FIG. 1
Figure 5:
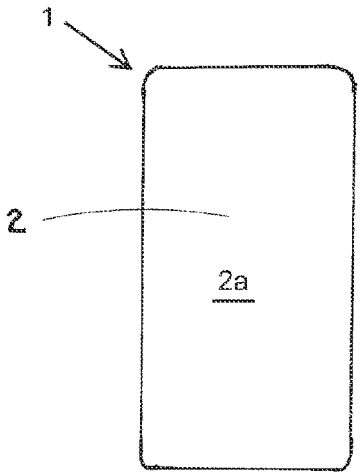
FIG. 5 is a top view of the stake of FIG. 1
Figure 6:
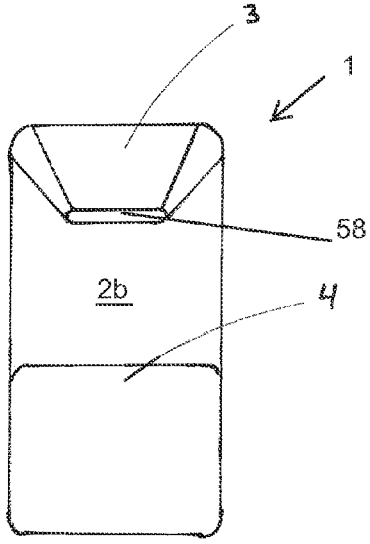
FIG. 6 is a bottom view of the stake of FIG. 1
Figure 7:
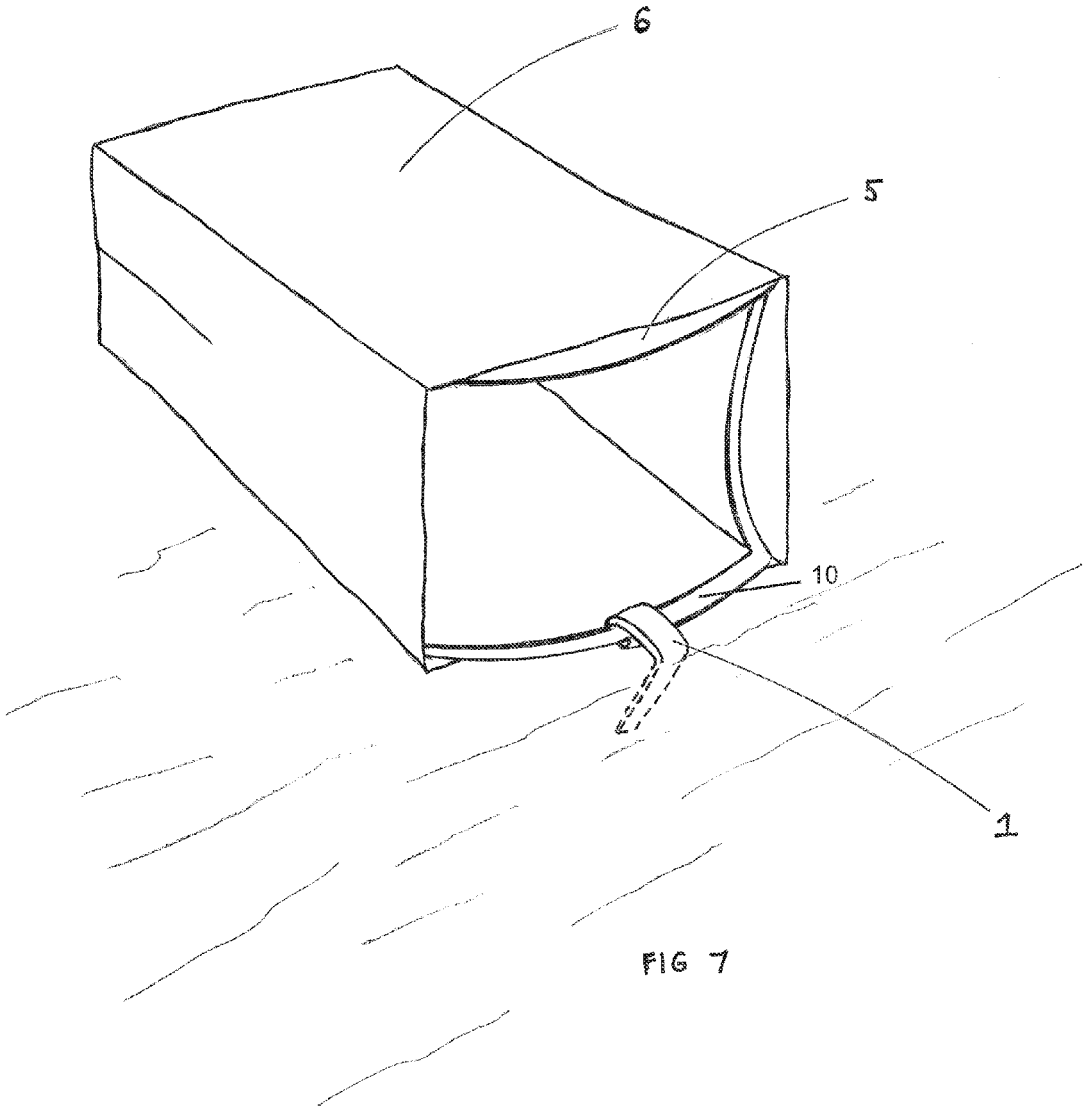
FIG. 7 is a perspective view of the stake of FIG. 1 shown removably secured to a bag mouth holder and opener positioned within a leaf and lawn bag.

The preferred embodiments of the present invention are illustrated in FIGS. 1-20. FIG. 1 illustrates a perspective view of one embodiment of a stake 1 with a head 2, spike portion 3, and a clip portion 4. In the embodiment shown in FIG. 1, stake 1 is for removably attaching to a bag mouth holder and opener as shown, for example, in FIG. 7. FIG. 2 shows a side view of the stake shown in FIG. 1; FIGS. 3, 4, 5, and 6 show front, back, top, and bottom views, respectively, of stake 1 of FIG. 1.

Head 2 of stake 1 transitions to a downwardly-extending spike portion 3 at a joint or bend 52. Spike portion 3 has a proximal end portion 56 positioned near head 2 and a tip 58. Spike portion 3 defines an angle 54 of about seventy-five degrees with head 2. In other embodiments, angle 54 is greater or less than seventy-five degrees, but is preferably less than ninety degrees. In another embodiment, angle 54 is about sixty degrees. To facilitate driving spike 3 into the ground, spike portion 3 tapers in thickness 60 and/or in width 62 moving form proximal end portion 56 to tip 58.

Clip portion 4 doubles back at a U-portion 65 and extends towards spike portion 3 substantially parallel to head 2. In the embodiment shown in FIGS. 1-7 and 15, clip portion 4 is below bottom surface 2*b* of head 2. Clip portion 4 and head 2 define an open loop with an inside surface 64 and a gap 72 between tip 4*a* of clip portion 4 and bottom surface 2*b* of head 2. Gap 72 is positioned about half way between inside face 3*a* of spike portion 3 and U-portion 65 and provides a point of entry to open region 66 between head 2 and clip portion 4. Open region 66 is shaped and configured to receive a member 10 of bag mouth holder and opener 5 (shown in FIG. 7) through gap 72.

Referring to FIG. 2, clip portion has a tip 4*a* that points toward bottom surface 2*b* of head 2 and defines a catch surface 68 to engage and retain upper member 10. Preferably, open region has a perimeter or shape 70 that closely or identically matches a cross-sectional shape 20 of upper member 10 (see FIG. 18) for attachment in mating agreement therewith. Shape 70 in one embodiment is a rectangle, a rectangle with rounded ends, a flattened oval, an ellipse, a rectangle with a domed side, or the like.

In one embodiment stake 1 is made of plastic using an injection molding process, such as a synthetic or semi-synthetic organic polymer. Stake is preferably flexible and resilient so that clip portion 4 can be temporarily displaced with tip 4*a* moving away from head 2 to more easily permit insertion of upper portion 10 of bag mouth holder and opener 5 into open region 66. Due to its resiliency, tip 4 then resumes its resting position with inside surface 64 and catch surface 68 engaging upper member 10 of bag mouth holder and opener 5. In one embodiment, stake 1 has a thickness of about 1/16" and width of about 1.25" along head 2, clip portion 4, and proximal end portion 56. Other dimensions are acceptable and depend on the material used and the desired physical characteristics (e.g., shear strength, flexibility, etc.) of stake 1.

Figure 8:
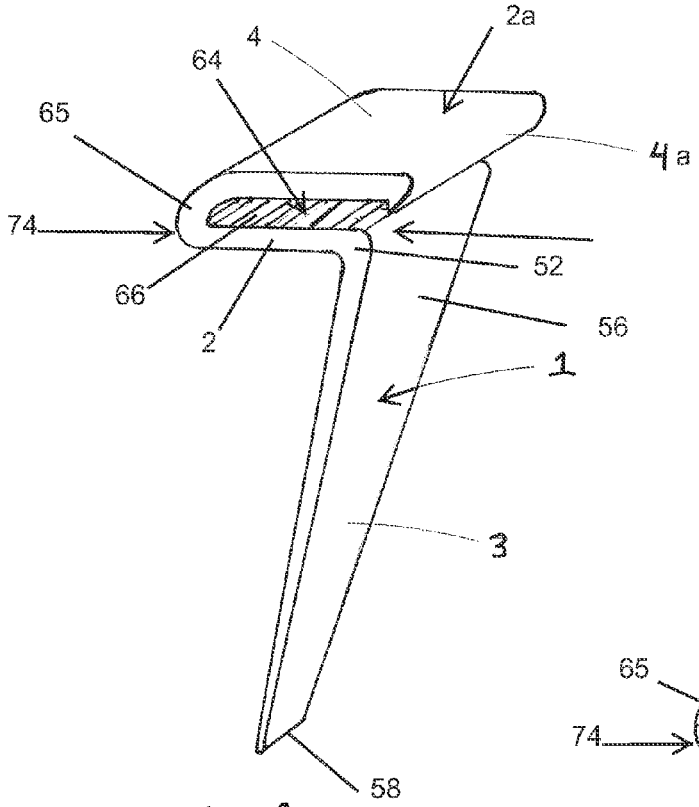
FIG. 8 is a perspective left side view of another embodiment of a stake of the present invention and shows the clip portion positioned over a top side of the head portion.
Figure 9:
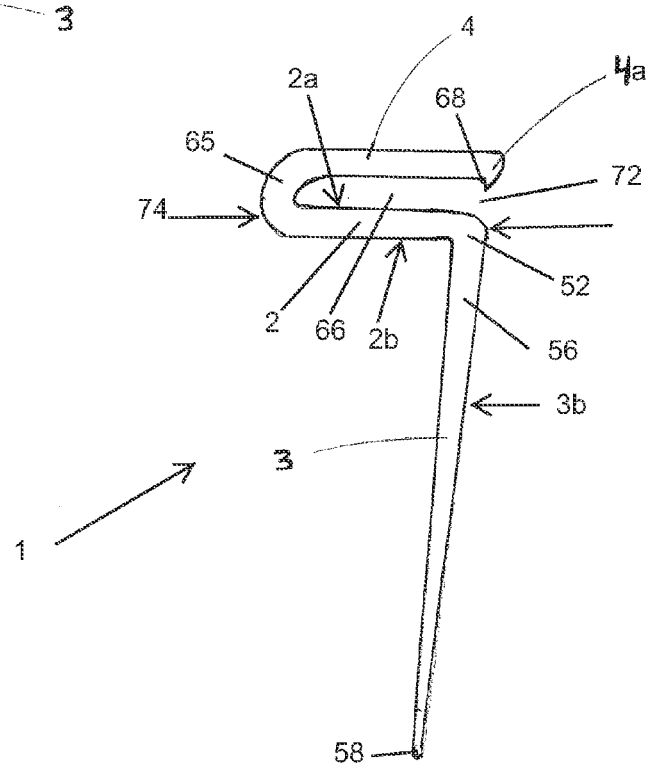
FIG. 9 is a left side view of the stake of FIG. 8
Figure 10:
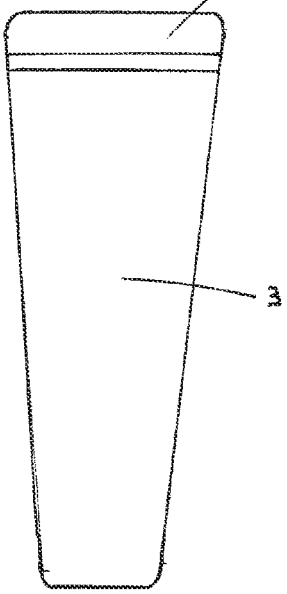
FIG. 10 is a front side view of the stake of FIG. 8.
Figure 11:
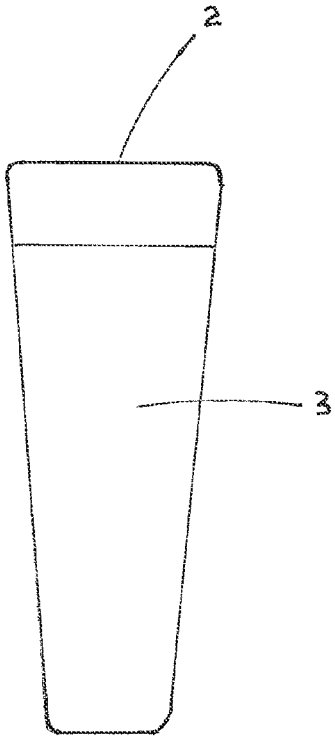
FIG. 11 is a back side view of the stake of FIG. 8.

Referring now to FIGS. 8-9, perspective and side views, respectively, illustrate another embodiment of stake 1. In the embodiment of stake 1 shown in FIGS. 8-14 and 16, clip portion 4 is positioned above top surface 2*a* of head 2. Tip 4*a* of clip portion 4 is directed downward towards top surface 2*a* of head and positioned approximately over bend 52. Gap 72 is positioned above bend 52 with open region and opening towards outside surface 3*b* of spike portion 3. Catch surface is preferably substantially parallel with spike portion 3.

Figure 12:
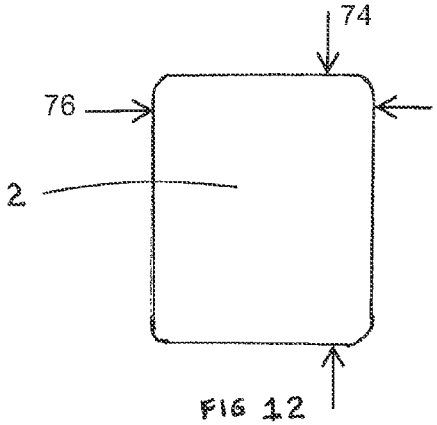
FIG. 12 is a top view of the stake of FIG. 8
Figure 13:
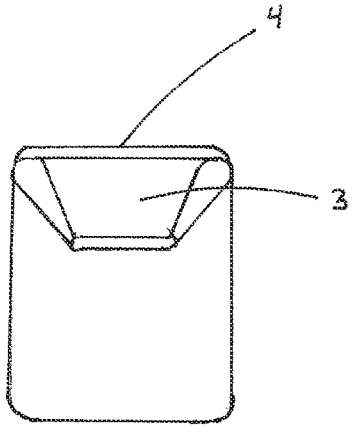
FIG. 13 is a bottom view of the stake of FIG. 8
Figure 14:
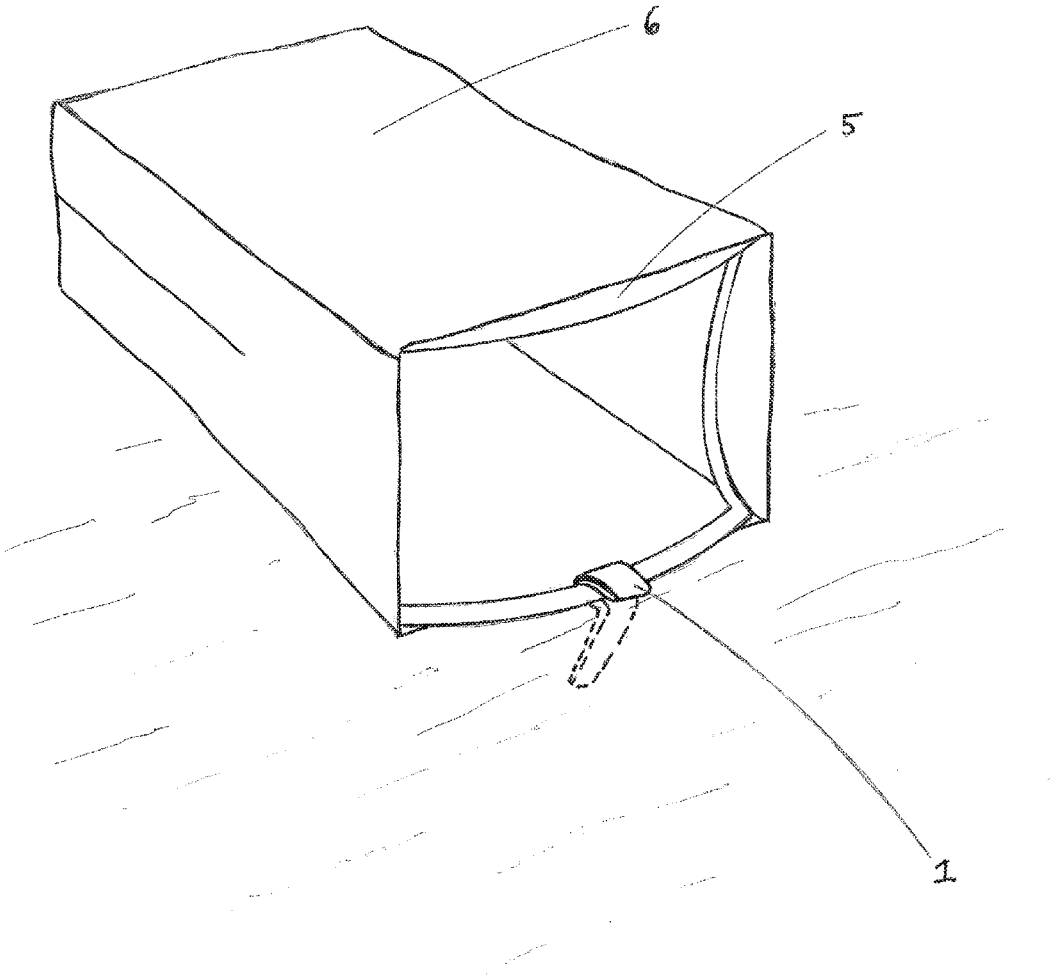
FIG. 14 is a perspective view of the stake of FIG. 8 shown removably attached to the bag mouth holder and opener positioned within the mouth of a leaf and lawn bag.

In one embodiment, inside surface 64 is textured, for example, with ribs, cross hatches, protrusions, or other feature that promotes non-slip engagement with upper member 10. In other embodiments, inside surface 64 has a non-slip finish or material chosen based on the material of bag mouth holder and opener 5. Because gap 72 is between top surface 2*a* of head 2 and clip portion 4, which is above head 2, length 74 of head 2 is reduced compared to the embodiment of FIG. 1. Referring to FIG. 12, length 74 in one embodiment is about the same as head width 76.

Figure 15:
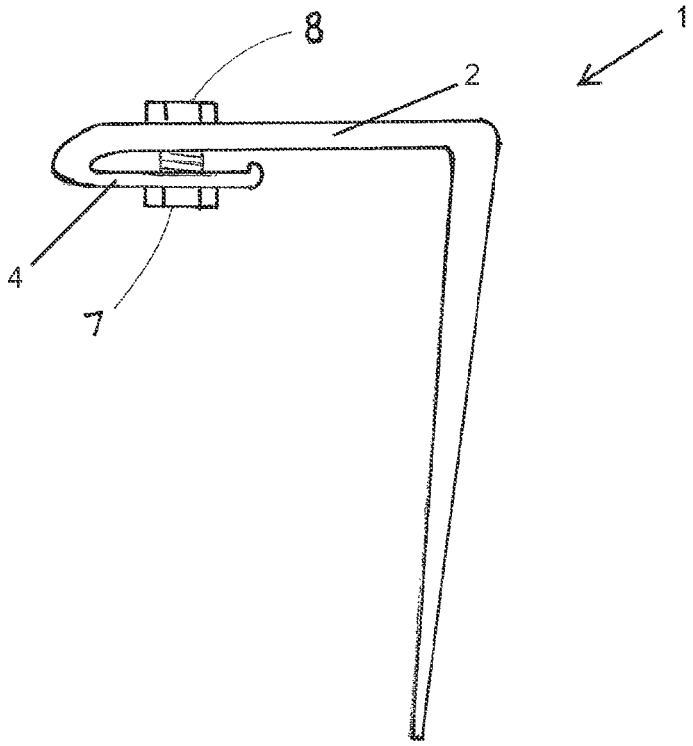
FIG. 15 is a left side view of the stake of FIG. 1 showing a nut and bolt for attachment through the head and clip of the stake and through a hole in a bag mouth holder and opener.
Figure 16:
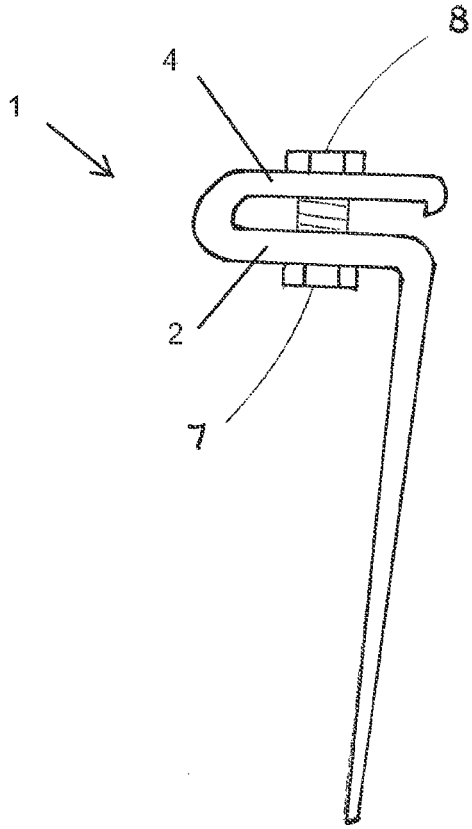
FIG. 16 is a left side view of the stake of FIG. 8 showing a nut and bolt for attachment through the head and clip of the stake and through a hole in a bag mouth holder and opener.

Referring to FIGS. 15-16, embodiments of stake 1 of FIG. 1 and FIG. 8, respectively, are shown with a nut 7 and a bolt 8 that extends through an opening (not shown) through head 2 and clip portion 4. Bolt 8 may also extend through an opening (not shown) in bag mouth holder and opener 5 to secure stake 1.

Figure 17:
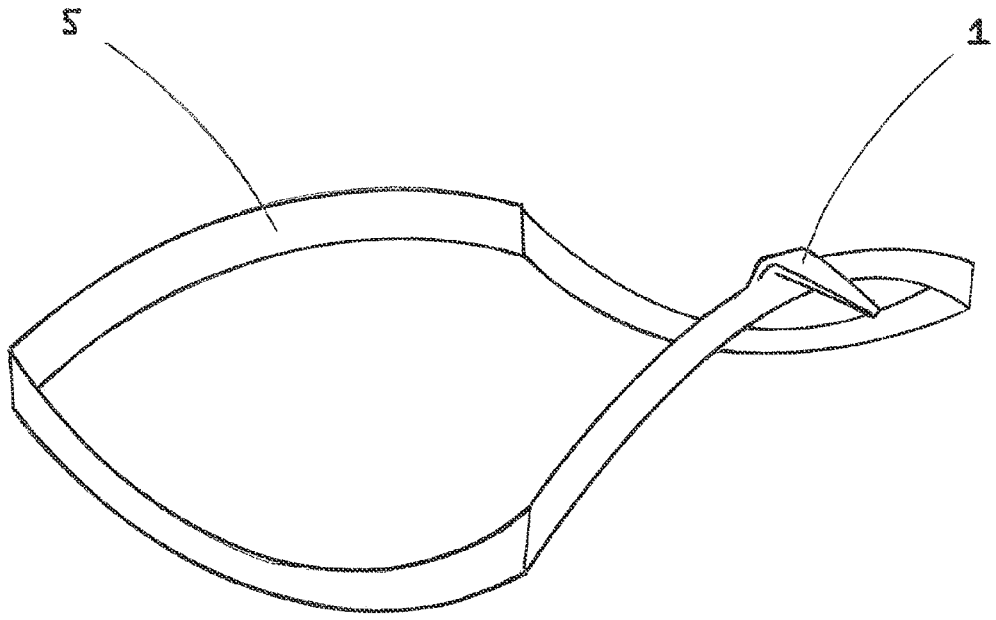
FIG. 17 is a perspective view of another embodiment of a stake of the present invention and shows the stake as a unitary structure with a bag mouth holder and opener.

FIG. 17 illustrates a perspective view of one embodiment of a stake 1 integrally connected to a bag mouth holder and opener 5 at a middle portion 12 of one curved upper member 10. Preferably, stake 1 is so positioned because middle portion 12 of curved upper member 10 is the portion of bag mouth holder and opener 5 that is near to or just outside of the mouth of bag 6 when bag mouth holder and opener 5 is positioned in a bag 6 as shown, for example, in FIG. 7.

Figure 18:
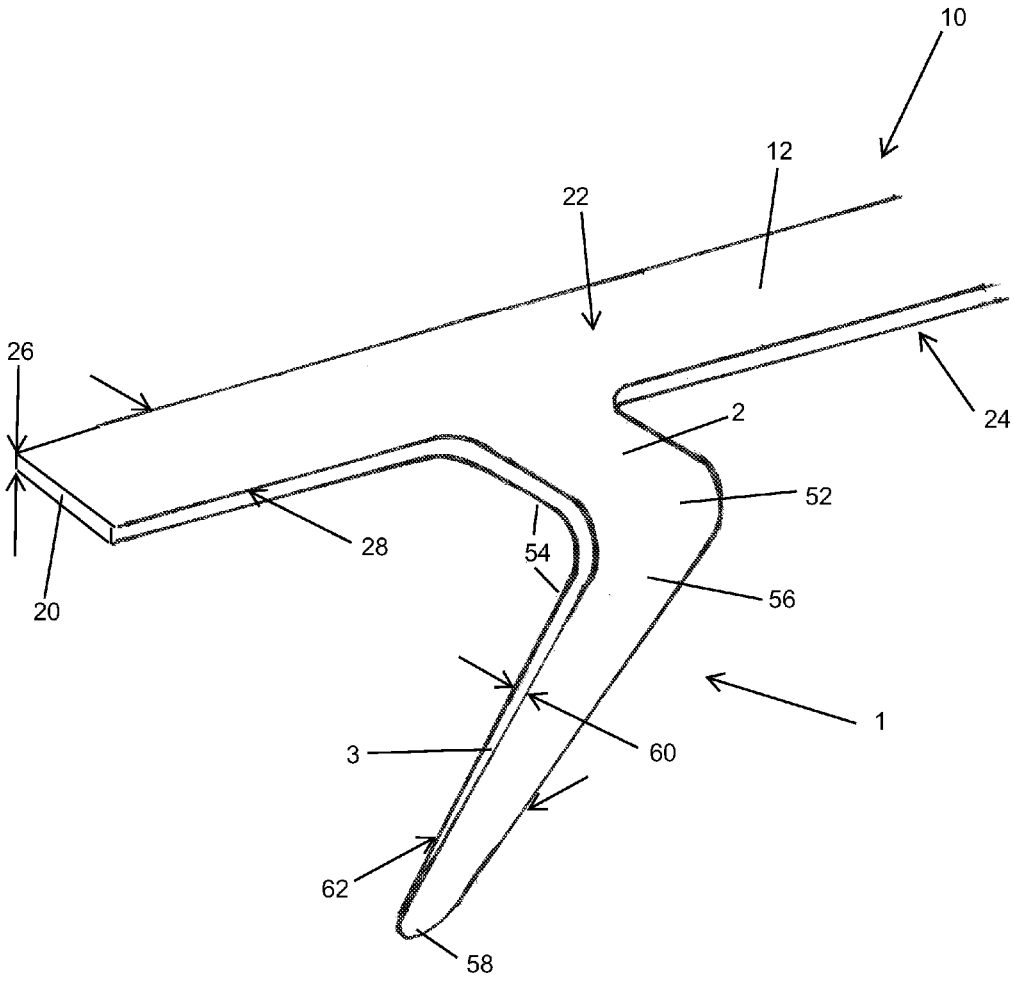
FIG. 18 is a close-up perspective view of the stake of FIG. 17 shown extending from an upper member of a bag mouth holder and opener.
Figure 19:
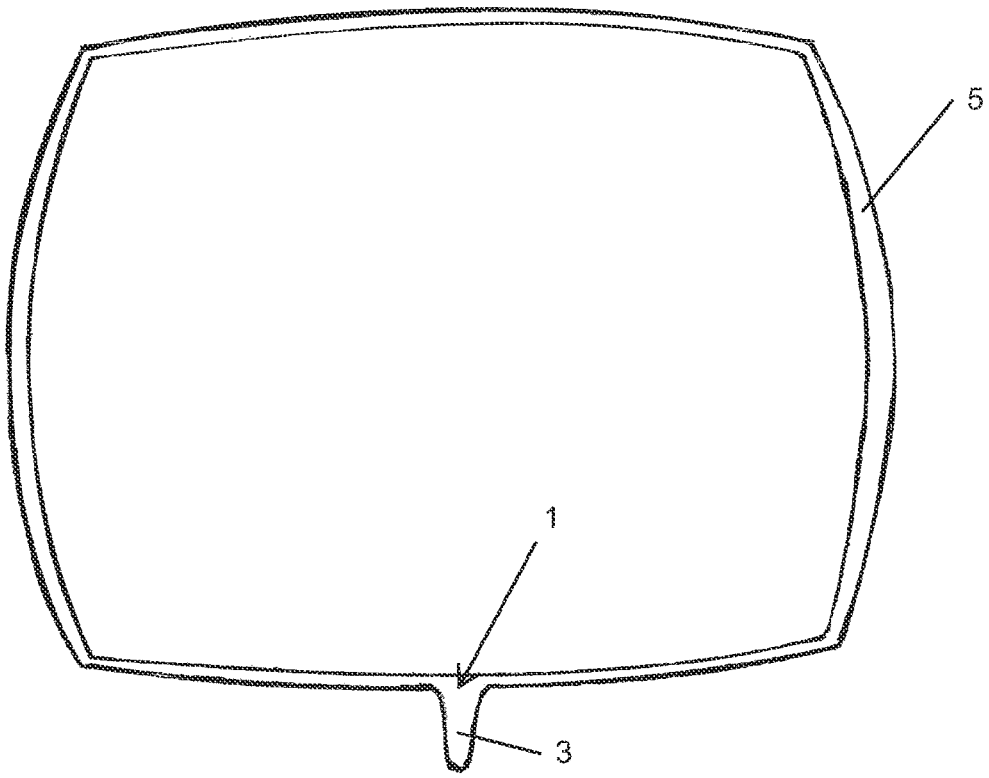
FIG. 19 illustrates a view looking through a bag mouth holder and opener showing an integrally-attached stake with spike portion extending downward from one of its members.

FIG. 18 illustrates a close-up view of middle portion 12 of upper member 10 with one embodiment of attached stake 1. In this embodiment, stake 1 comprises a unitary structure with bag mouth holder and opener 5. In one embodiment, upper member 10 is a flattened longitudinal member with a top surface 22, a bottom surface 24, and a substantially rectangular cross-sectional shape 20. Preferably, cross-sectional shape 20 has a height 26 that is significantly smaller than a width 28. A stake head 2 extends transversely (e.g., perpendicularly) from curved member 10 substantially in the same planes defined by top surface 22 and bottom surface 24. Preferably, head 2 defines a T-shape with upper member 10, which is useful to provide a surface for a user's foot to press stake 1 into the ground. FIG. 19 illustrates a view looking through bag mouth holder and opener 5 with spike portion 3 of stake directed downward.

Similar to the embodiment shown in FIG. 1, an integrally-attached stake 1 has a bend 52 that transitions to a downwardly-extending spike portion 3 with proximal end portion 56 and tip 58. Spike portion 3 defines an angle 54 of about sixty or seventy-five degrees with spike head 2. In other embodiments, angle 54 is greater or less than seventy-five degrees, but is preferably less than ninety degrees. To facilitate driving spike 3 into the ground, spike tapers in thickness 60 and/or in width 62 moving form proximal end portion 56 to tip 58.

When stake 1 is integrally connected to bag mouth holder and opener 5 as shown in FIGS. 17-18, stake is preferably made of the same materials and formed during the same manufacturing process as bag mouth holder and opener 5. In one embodiment, bag mouth holder and opener 5 and stake 1 are made of plastic, polypropylene, rubber, and aluminum. In another embodiment, stake 1 is rubber or plastic and is optionally reinforced with metal or other rigid material.

Figure 20:
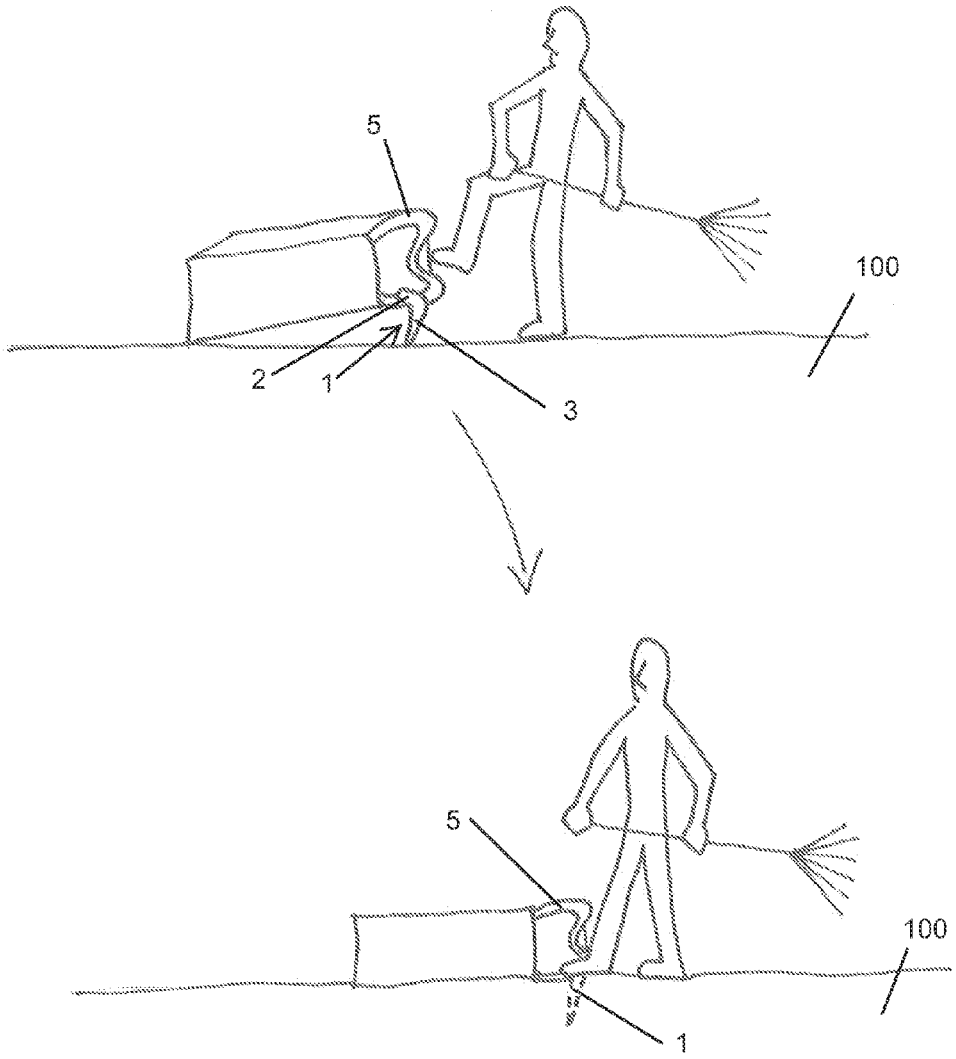
FIG. 20 illustrates steps in a method of using a stake of the present invention.

Referring to FIG. 20 one uses stake 1 of FIG. 1 by attaching stake 1 to upper member 10 of the bag mouth holder and opener 5 such that the spike portion 3 of stake 1 is directed away from the bag mouth holder and opener 5. When stake 1 is attached in position, the user can lay the stake 1 and bag mouth holder and opener 5 in combination on the ground 100 such that the spike portion 3 points directly downward. Then, the user can apply pressure to the stake head 2 by foot, hand, rake or any other means such that the spike portion 3 is pushed in to the ground 100, securing the bag mouth holder and opener 5 and stake 1 in combination to a fixed position.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. A stake for a bag mouth holder comprising:

a longitudinal spike with a distal end and a stake tip opposite the distal end;

a head portion having a first end and a second end, the first end connected to the distal end of the longitudinal spike, wherein the head portion extends transversely from the longitudinal spike at a predefined angle; and a clip portion with a first clip end and a second clip end, the second clip end having a clip tip extending transversely therefrom towards the head, the first clip end connected to the second end of the head portion with the clip portion extending generally towards the first end and substantially parallel to and spaced apart from the head portion;

wherein the head portion and the clip portion define an open space therebetween;

wherein the open space is shaped to receive one upper portion of a bag mouth holder with the clip portion and the head portion engaging the upper portion, wherein the bag mouth holder has the general shape of a rectangular perimeter of a hyperbolic paraboloid with upper, middle, and lower portions that define a rectangular opening, the middle portions being oriented in a generally perpendicular position relative to the upper portions and to the lower portions, the bag mouth holder being temporarily changeable from an uncompressed shape to a compressed shape when subjected to applied pressure enabling the bag mouth holder to be placed within a refuse bag with the middle portions substantially parallel to a longitudinal axis of the refuse bag and the upper portions protruding outward from a top portion of the refuse bag, the bag mouth holder being changeable again to the uncompressed shape when disposed within a mouth of the refuse bag by releasing the applied pressure, thereby causing the middle portions to exert outward force on interior corners of the refuse bag adequate to maintain the mouth of the refuse bag in the open position.

2. The stake according to claim 1, wherein the open space substantially has a shape selected from the group consisting of a rectangle, a rectangle with rounded ends, and a rectangle with a domed side.

3. The stake according to claim 1, wherein head portion and clip portion are textured for engagement with the one upper portion of the bag mouth holder and opener.

4. A stake for a bag mouth holder comprising:

a longitudinal spike with a distal end and a stake tip opposite the distal end;

a head portion having a first end and a second end, the first end connected to the distal end of the longitudinal spike, wherein the head portion extends transversely from the longitudinal spike at a predefined angle; and a clip portion with a first clip end and a second clip end, the second clip end having a clip tie extending transversely therefrom towards the head, the first clip end connected to the second end of the head portion with the clip portion extending generally towards the first end and substantially parallel to and spaced apart from the head portion;

wherein the head portion and the clip portion define an open space therebetween; and wherein the head portion defines a first through opening and the clip portion defines a second through opening, the first through opening being aligned with the second through opening to receive a fastener therethrough.

5. An apparatus for maintaining a mouth of a refuse bag in an open position, the device comprising:

a generally-rectangular frame independent from the refuse bag, the generally-rectangular frame defining an opening with a central axis therethrough, the generally-rectangular frame comprising:

a pair of spaced apart, substantially-parallel, upwardly-curved members each having a proximal end and a distal end;

a pair of spaced apart, substantially-parallel downwardly-curved members, wherein one of the pair of downwardly-curved members is connected between the proximal ends of the upwardly-curved members and another one of the pair of downwardly-curved members is connected between the distal ends of the upwardly-curved members; and a stake head portion having a first end and a second end, the first end extending from the generally-rectangular frame in a direction substantially parallel to the central axis; and a longitudinal spike with a distal end and a stake tip, the distal end connected to and extending transversely from the first end of the stake head portion at a predefined angle between about sixty and about ninety degrees;

wherein the generally-rectangular frame is capable of being compressed for insertion into and removal from the mouth of the refuse bag;

wherein a portion of the generally-rectangular frame is capable of protruding from the mouth of the refuse bag when positioned in the mouth of the refuse bag to maintain the mouth of the refuse bag in an open position; and wherein when the generally-rectangular frame is positioned in the mouth of the refuse bag, the generally-rectangular shape of the resilient frame maintains the rectangular shape of the mouth of the refuse bag;

wherein the longitudinal spike is configured to be driven into a ground when the device is positioned in the mouth of the refuse bag to retain the device in a fixed position on the ground; and a clip portion with a first clip end and a second clip end, the second clip end having a clip tip extending transversely therefrom and towards the stake head portion, the first clip end connected to the first end of the stake head portion with the clip portion extending substantially parallel to and spaced apart from the stake head portion, wherein the stake head portion and the clip portion define an open space therebetween and a gap between the clip tip and the head portion;

wherein the open space is shaped to receive one of the upwardly-curved members or the downwardly-curved members with the clip portion and the head portion in engagement therewith.

6. The apparatus according to claim 5, wherein the open space substantially has a shape selected from the group consisting of a rectangle, a rectangle with rounded ends, and a rectangle with a domed side.

7. The apparatus according to claim 6, wherein the head portion and the clip portion are textured for non-slip engagement with the one of the upwardly-curved members or the downwardly-curved members.

8. The apparatus according to claim 5, wherein the head portion defines a first through opening and the clip portion defines a second through opening, the first through opening being substantially aligned with the second through opening for receiving a fastener therethrough.

9. The apparatus of claim 5, wherein the stake head portion and the longitudinal spike are integrally formed with the generally-rectangular frame.

* * * * *